United States Patent [19]

Castle

[11] 4,154,071

[45] May 15, 1979

[54] AUXILIARY LOCKING MECHANISM

[76] Inventor: Alfred B. Castle, 4104 Maryland Ave, Washington, D.C. 20016

[21] Appl. No.: 770,795

[22] Filed: Feb. 22, 1977

[51] Int. Cl.[2] ..... E05B 13/02; E05B 17/14

[52] U.S. Cl. ..... 70/424; 70/428

[58] Field of Search ..... 70/345, 360, 424, 428, 70/DIG. 56; 292/59, 62, 68, 89; 24/221 A, 221 K, 221 L

[56] References Cited

U.S. PATENT DOCUMENTS

| | | | |
|---|---|---|---|
| 305,348 | 9/1884 | Smith | 292/62 |
| 534,987 | 3/1895 | Alsdorf | 292/62 |
| 1,472,978 | 11/1923 | Treiman | 70/428 |
| 1,580,611 | 4/1926 | Kirkpatrick | 70/345 X |
| 2,216,385 | 10/1940 | Chobert | 24/221 K |
| 2,676,479 | 4/1954 | Bethune | 70/345 X |
| 2,922,211 | 1/1960 | Boyd | 24/221 K |
| 3,564,563 | 2/1971 | Trotter et al. | 24/211 K |
| 3,894,416 | 7/1975 | Castle | 70/150 |

*Primary Examiner*—Thomas J. Holko
*Attorney, Agent, or Firm*—Rose & Edell

[57] ABSTRACT

The auxiliary locking mechanism of my prior U.S. Pat. No. 3,894,416 is more securely detended and greatly simplified in construction by forming the locking part of the mechanism that is to engage the surrounding metal as a rectangular body and forming a rectangular recess in the part of the surrounding metal that is to be engaged by the aforesaid locking part. The locking part is movable axially of the remainder of the mechanism so that when the mechanism is inserted into a rectangular opening in the side of the body remote from the rectangular recess, the locking part may be depressed and rotated to be aligned with the recess and then released so that it becomes seated in the recess and is securely detented.

4 Claims, 5 Drawing Figures

FIG. 1
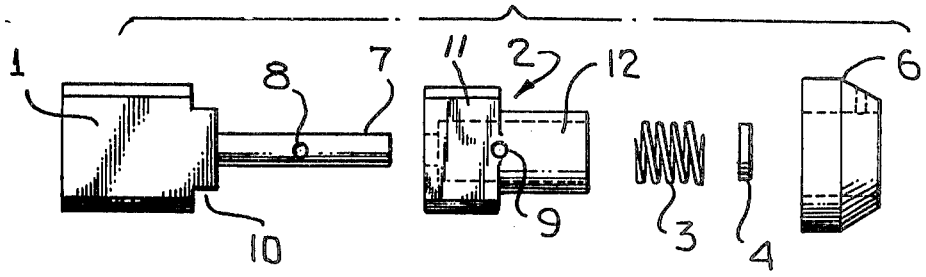
FIG. 2
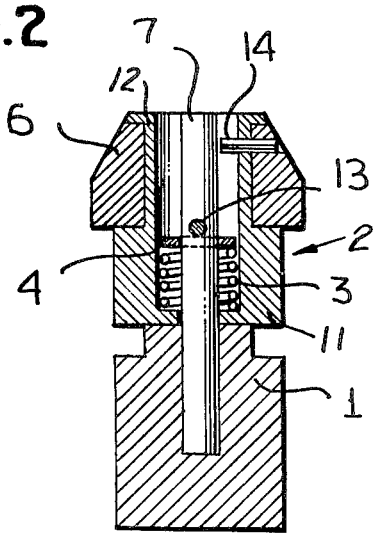
FIG. 3
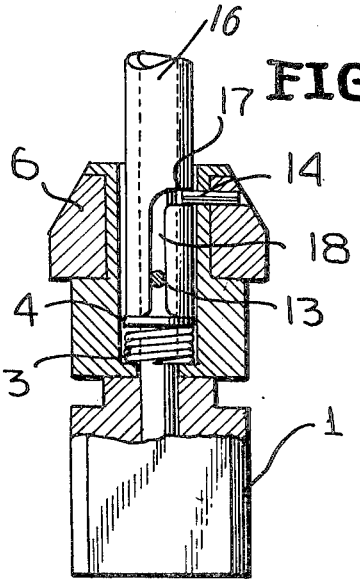
FIG. 4
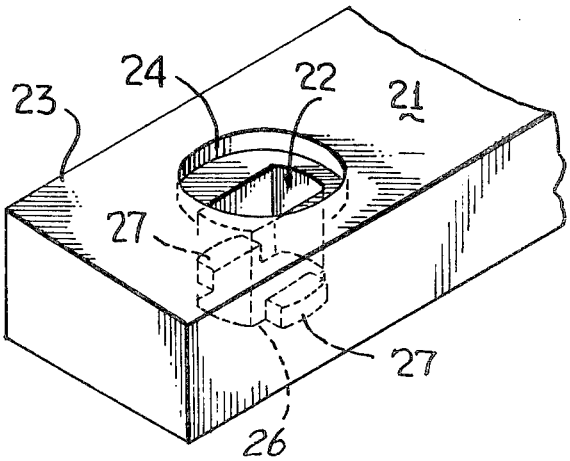
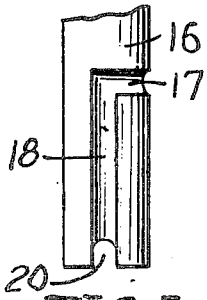
FIG. 5

AUXILIARY LOCKING MECHANISM

BACKGROUND OF THE INVENTION

The present invention relates to auxiliary locking mechanisms and more particularly to an improvement in the auxiliary locking mechanism as disclosed in my U.S. Pat. No. 3,894,416.

The mechanism of said patent provides a measurable increase in safety to the Castle Lock, see my U.S. Pat. No. 2,608,085. However, the device requires improvement from the point of view of detention and costs.

The detenting of the mechanism of the prior patent was accomplished by a spring-biased ball located in one part of the mechanism cooperating with indentations in another part of the mechanism, the two parts being rotated relative to one another for locking and unlocking. The part that was rotated to produce locking had rectangular body with rounded ends so that it could be rotated into rounded recesses formed in the slide bolt of the Castle Lock.

The aforesaid detenting arrangement was costly due to the extra processes required to provide the detent. Further detenting was not positive; i.e. application of force directly on the rotatable part, body, would unlock the mechanism and permit its removal.

SUMMARY OF THE INVENTION

In accordance with the present invention, the auxiliary locking mechanism of the prior patent is modified by providing a rectangular shoulder on one end of the rotatable lock member; the end closest to the stationary member. A rectangular groove of corresponding size is formed in the side of the Castle Lock bracket adjacent the slide bolt, the said rectangular groove lying at the end of the key slot adjacent the slide bolt of the Castle Lock.

The locking part of the auxiliary locking mechanism has a rod extending into the stationary part of the auxiliary lock. A spring, washer and pin arrangement resiliently biases the locking part to the stationary part of the lock.

The locking part of the auxiliary lock must be depressed by its key upon insertion and then rotated into alignment with the slot in the Castle Lock bracket and then released so that it is seated therein. Thus, detenting is effected by cooperation of the locking member and the bracket and can be released only by simultaneously rotating and depressing the locking member.

It is, therefore, our object of the present invention to modify the auxiliary locking mechanism of the U.S. Pat. No. 3,894,416 to reduce its cost and increase its safety features.

DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein:

FIG. 1 is an exploded side view of the mechanism of the present invention;

FIG. 2 is a view in elevation of a cross-section of the assembled mechanism;

FIG. 3 is a view of the key inserted in the auxiliary locking device during a locking or unlocking cycle, FIG. 4 illustrates the manner in which detenting is effected in accordance with the present invention; and FIG. 5 is a view in elevation of the key employed in the present apparatus.

Referring specifically to FIG. 1 of the accompanying drawing, the mechanism of the present invention comprises only five parts plus two pins. The mechanism includes a locking member 1, a stationary member 2, a spring 3, a washer 4 and a head member or stationary locking member 6.

The stationary member 1 has a rod 7 which extends centrally from the right surface, as viewed in FIG. 1, a distance about equal to the assembled length of the members 2 and 6, see FIG. 2. The rod 7 has a transverse hole 8 drilled at right angles to the plane of the major dimension of the member 1. The stationary member 2 has a hole 9 drilled in alignment with the hole 8 when the members are assembled.

The locking member 1 has a rectangular shoulder formed on its end adjacent the member 2 and forms, in conjunction with a rectangular recess formed in the Castle Lock bracket, the detenting arrangement of the invention.

The member 2 has a rectangular part 11 adjacent to and of the same size as the main body of member 1 and at its right end, as viewed in FIG. 1, terminates in a hollow cylindrical member 12 for receiving the end cap or stationary locking member 6.

In the assembled device, see FIG. 2, the rod 7 extends through a hole in the adjacent end of member 2 and into hollow cylinder 12. The washer is inserted in cylinder 12 over the rod 7 and washer 4 is slid over it. The washer is depressed and pin 13 is inserted through hole 9 in member 2 and into aligned hole 8 in rod 7. The pin is inserted sufficiently so that it clears member 2 whereby the rod 7 and therefore member 1 may be rotated relative to member 2 by engaging pin 13 and turning it.

A pin 14 is inserted through members 6 and 12 and extends almost into contact with rod 7. The pin 14 is at right angles to pin 13 when the mechanism is in its unlocked position, i.e., with members 1 and 2 in dimensional alignment.

Referring specifically to FIGS. 3 and 5 of the accompanying drawing, the key employed to lock and unlock the mechanism of the invention is the same as disclosed in U.S. Pat. No. 3,894,416 except that the cross slot is slightly deeper. Specifically, the key is an axially slotted, hollow rod 16 having a transverse slot 17 in communication with axial slot 18. A quite short axial slot 20 (see FIG. 5) is formed at the lower end of the key, as viewed in FIG. 5 along the same diameter as slot 18 so as to accommodate the other end of pin 13. When the key is pushed into the end of the lock, the slot 18 straddles pin 13. The pin 13, however is engaged by the top of the slot 20 so that as the key is pushed in further the pin 13 is pushed against washer 4 which compresses spring 3. Concurrently with movement of the pin 13 the rod 7 is moved downward, for instance, as seen in FIG. 3.

In use i.e. the lock is in the locked position, slot 18 is slid down along pin 14 until the slots 18 and 20 in the end of the rod are positioned around the pin 13. It should be noted that the key (rod) may be inserted in the lock only when in the locked position. When in the unlocked position, the mechanism cannot be removed from the end of the rod, thereby to prevent loss of the device.

The rod 16 is now depressed and rotated 90 degrees. The body 1 has now been rotated 90 degrees into its unlocked position, but the key cannot be removed because the pin 14 is in the slot 17.

It is noted that the body 1 was moved away from body 2 upon pressure being applied to washer 4 by the rod (key) 16. Referring now specifically to FIG. 4, that portion of the main body of the Castle Lock that cooperates with the device of the invention is illustrated.

The Castle Lock has a bracket 21 having a rectangular slot 22 extending therethrough. The upper surface 23, as illustrated in FIG. 4, of the bracket has a circular recess 24 of a diameter and depth to receive member 6 of the mechanism. Lower surface 26 of the bracket 21 has a transverse rectangular recess 27 formed in opposed sides of the slot 22 of a size to accomodate the rectangular end member 10 of the body 1 when the body is in its locked position, i.e., 90 degrees relative to the position illustrated in FIG. 2.

The slot 22 is of a size to accomodate body 2 of the auxiliary lock and the lower surface 26 of the bracket is a distance from the recessed surface 24 greater than the distance between adjacent part of members 1 and 6 when positioned as illustrated in FIG. 2.

In use the lock is aligned as illustrated in FIG. 2 and inserted in the slot 22 in the bracket 21. The pin 13 is depressed against the spring 3 depressing the body 1 so that it is disposed below surface 26 of the bracket. The rod is now rotated 90 degrees until the major dimension of the member 1 is aligned with the recess 27. The rod is now withdrawn from the lock and the main body of member 1 seats in the recess and the shoulder 10 is seated in the slot. Thus, by simply providing a rectangular slot in the bottom of the bracket, positive detenting with extensive simplicity and low cost is provided.

While I have described and illustrated one specific embodiment of my invention, it will be clear that variations of the details of construction which are specifically illustrated and described may be restored to without departing from the true spirit and scope of the invention as defined in the appended claims.

I claim:

1. An auxiliary locking mechanism for blocking access to a primary locking mechanism which has a key hole extending through a support wall for the primary locking mechanism, said auxiliary locking mechanism comprising:

a first member adapted to fit tightly in said key hole;

a second member positioned adjacent one end of said first member so as to extend through said key hole when said first member is positioned tightly in said key hole;

said first and second members being positioned along a common axis;

actuable means for rotating said second member about said axis relative to said first member and for securing said first and said second member to one another for movement relative to one another along said axis, said actuable means comprising an actuator bar extending along said common axis and fixedly secured to said second member for rotation therewith;

wherein the periphery of said second member is contoured to permit removal of said first and second members from said key hole for at least one mutual rotational position of said members and to abut said support wall and thereby block removal of said members from said key hole for at least a second mutual rotational position of said members; and means for effective rotation of said actuable means about said common axis concurrently with axial relative movement of said first and second members bias means for urging adjacent surfaces of said first and second members into abutting relationship; and said second member having a rectangular shoulder adjacent said second member.

2. An auxiliary locking mechanism according to claim 1 wherein said actuable means comprises a pin extending through said actuator bar, and wherein said means for effecting rotation comprises means for engaging said pin to effect axial and rotational movement thereof.

3. A locking device comprising a hollow member having an end wall, an aperture in said end wall coaxial with said hollow member, a second member a rod extending from an end wall of said second member, said rod extending through said aperture into the hollow region of said hollow member said rod being axially slidable in said aperture, a first pin located in the hollow region of said hollow member and extending through said rod transverse to the axis of said rod, a compression spring extending between said pin and said end wall for biasing said end wall of said second member into engagement with said end wall of said hollow member, a second pin extending from a wall of said hollow member into the hollow region, said first pin being in generally axial alignment with said second pin when said second member is in a first position, and means for engaging said first pin for rotating said rod between first and second positions.

4. A locking device according to claim 3 further comprising a hollow rodlike key having a first axially extending slot, a transverse slot, said slots mutually terminating one in the other, said key having a second axially slot extending diametrically opposed to said first axial slot, said second slot having a length small compared to the distance between said first pin and said end wall of said hollow member.

* * * * *